US006708934B2

(12) United States Patent
Brueske

(10) Patent No.: US 6,708,934 B2
(45) Date of Patent: Mar. 23, 2004

(54) UNITARY HOSE SUPPORT

(75) Inventor: David J. Brueske, Perris, CA (US)

(73) Assignee: JCube Industries LLC, Oak Brook, IL (US)

( * ) Notice: Subject to any disclaimer, the term of this patent is extended or adjusted under 35 U.S.C. 154(b) by 0 days.

(21) Appl. No.: 09/775,380

(22) Filed: Feb. 1, 2001

(65) Prior Publication Data

US 2001/0032910 A1 Oct. 25, 2001

Related U.S. Application Data

(60) Provisional application No. 60/180,561, filed on Feb. 4, 2000.

(51) Int. Cl.[7] ..... B05B 15/06

(52) U.S. Cl. ..... 248/80; 248/75; 248/89

(58) Field of Search ..... 248/80, 75, 78, 248/89, 90

(56) References Cited

U.S. PATENT DOCUMENTS 603,207 A * 4/1898 Ruby ..... 248/90
955,260 A * 4/1910 Getman ..... 248/89
3,029,933 A * 4/1962 Sutter ..... 206/577
3,555,924 A * 1/1971 Favel ..... 248/89
4,436,267 A * 3/1984 Eads et al. ..... 248/75
5,419,362 A * 5/1995 Blackaby ..... 137/355.16
5,634,615 A * 6/1997 Shuen ..... 248/89
5,699,987 A * 12/1997 Romaneschi et al. ..... 248/89
5,988,570 A * 11/1999 Gretz ..... 248/74.2
6,059,215 A * 5/2000 Finnis ..... 242/200.1
6,079,675 A * 6/2000 Hsu ..... 248/75

* cited by examiner

*Primary Examiner*—Anita King
(74) *Attorney, Agent, or Firm*—Stephen J. Koundakjian

(57) ABSTRACT

A structure for supporting a flexible hose, including: a curved, essentially rectangular bearing surface; an attachment tab projecting upwardly from a longer side of the bearing surface, for attachment to a support structure; a pair of restraining tabs projecting upward at the opposite side of the bearing surface; and reinforcement dimples imposed into the junction of each restraining tab and the bearing surface, at the lower portion thereof. An embodiment of this structure has rib stiffeners running along the longitudinal axis of the bearing surface. In each case, the hose support is a unitary article, i.e., a single structure, without any weld or other attachment to interconnect its various elements.

13 Claims, 2 Drawing Sheets

UNITARY HOSE SUPPORT

CROSS-REFERENCE TO RELATED APPLICATION

This application derives from provisional Patent Application Serial No. 60/180,561, filed on Feb. 4, 2000, in the name of the present inventor, with identical specification and drawing.

BACKGROUND OF THE INVENTION

1. Field of the Invention

This invention relates to the field of garden hose support and storage devices.

2. Description of Prior Art

Everyone who has had experience with garden hoses is familiar with the problem of how to store them to avoid the formation of kinks that would eventually shut of or at least diminish water flow through the hose, as well as how to move them out of the way of children and others who might trip on them and thus expose themselves to perhaps serious injury. Winding the hose into a circular heap, after use, might reduce these risks, and is certainly a better option than loosely draping it over the faucet or its water supply pipe. However, most people do not possess the requisite skill—not to mention the patience and discipline—to retrieve the hose and carefully feed it into a neatly-defined circular heap in a safe place, every time it is used. Thus, in the ordinary situation, the hose is left where it lies, as a hazard to itself and to those who pass over it.

It is well known that one way to solve both of these problems is to provide some means whereby the hose can be collected up easily and wound around a support device having wheels and other hardware to permit its easy movement to a storage location or to faucets in various locations, to which it may be selectively connected for watering purposes. Many of these hose carts are available commercially, and they serve their purpose reasonably well. However, they can be unnecessarily heavy, cumbersome and expensive if used in a context where the hose does not often need to be relocated.

An alternative, where a single faucet is normally utilized, with relatively infrequent detachment and movement of the hose, is to provide a support structure than can be attached to a wall near that faucet. Such a structure would preferably be cylindrical in shape, or at least possess a curved upper surface, so that the hose could be wound smoothly around its periphery, or the circular portion of its periphery, to prevent the formation of kinks. This type of structure, which is likewise commercially available, is a relatively inexpensive and efficient alternative to simply draping the hose over and/or around the vertical faucet water supply pipe. Indeed, some of the better devices in this category are provided with openings that can be fitted over bolts or other projections in the wall, so that the hose support can be lifted up and secured onto those projections, and later easily removed for placement at another location fitted with similarly spaced projections.

One such hose support device is shown in FIGS. 1 and 2 of the Drawing, and is typical of the products on the market. This particular design will be discussed in more detail, in connection with the ensuing discussion of the preferred embodiments of the invention. Suffice to say that in order to fabricate such a device, a plurality of elements must be manufactured and then attached to form the finished product. Such a manufacturing process requires a considerable amount of labor, not to mention storage and inventorying of parts. This, of course, increases the ultimate cost of the device to the consumer.

What is needed, then, is a relatively simple hose support device that can easily be attached to a wall or other structure to minimize the hazard of injury by tripping, which can support a hose in a natural configuration to avoid kinking, which is structurally sound enough to support a considerable length of hose over a lengthy period of service, and which can be fabricated as a unitary device, in a simple operation requiring a minimum of hands-on labor.

BRIEF SUMMARY OF THE INVENTION

The invention is a hose support whose principal bearing surface is configured essentially as a curved rectangle, with at least one apertured attachment tab projecting normally from one of the longer sides of the rectangular region and at least a pair of restraining tabs projecting from the opposite side of the bearing surface. Strengthening dimples are imposed into the portion of each restraining tab where they join the bearing surface. The entire structure is unitary, and is fabricated from a single piece of metal or other suitable material by means of a two-stage die, the first stage cutting the blank from sheet metal and the second stage pressing the blank into the finished structure. In some embodiments, the bearing surface is corrugated for added strength, these rib stiffeners being added as a part of the second stage forming process.

Other aspects of the invention will be seen in reference to the Drawing and the ensuing discussion of the preferred embodiments in reference thereto.

DETAILED DESCRIPTION OF THE PREFERRED EMBODIMENT

Figure 1:
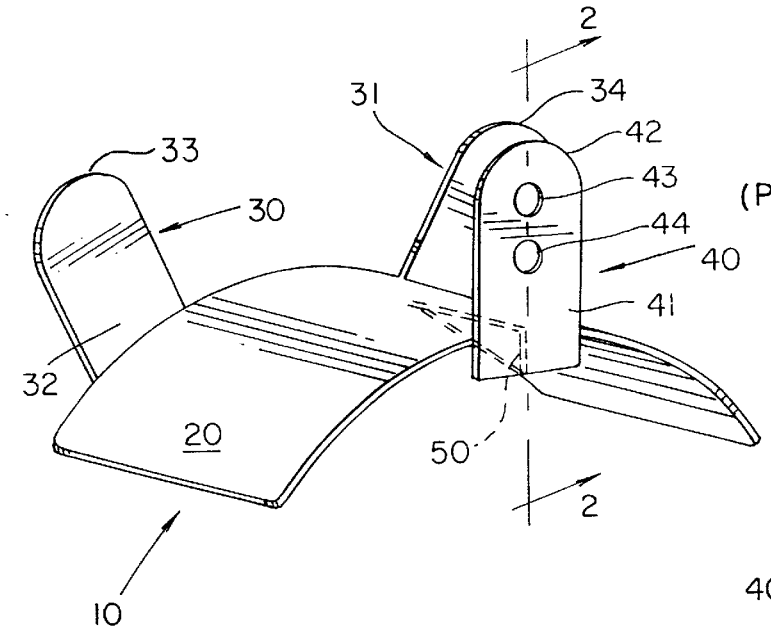
FIG. 1 (PRIOR ART)
FIG. 1 is a perspective view of a prior art hose support, fabricated from multiple elements.

Referring now to FIG. 1, the principal prior art hose support 10, of the general type relating to the present invention, comprises a bearing surface 20 having the shape of a curved rectangle. Typically the configuration of the curve is circular, with a fairly large radius, so that the hose (not shown) can be draped over it and hung in a series of loose curves below the structure.

The hose is supported upon the bearing surface 20, between a pair of restraining tabs 30,31 on one of the longer sides of the bearing surface, and an attachment tab 40 projecting normally from the opposite side of the bearing surface. The restraining tabs may project normally from the bearing surface, or at some other angle, depending on a number of factors, including the length of hose that will be supported (i.e., the number of winds around the hose support necessary to contain it).

The restraining tabs 30,31 will normally each comprise a base portion 32 (the base portion corresponding to restraining tab 31 hidden behind the bearing surface, in FIG. 1) and a curved apex 33,34. Of course, the shape of the apex need not be curved, although a curved shape is conventionally employed to present no sharp edges that might otherwise injure the hose or the person using it.

The attachment tab 40 comprises a base portion 41 and a curved apex 42. Once again, the apex need not be curved, although it normally is for the reasons mentioned in connection with the restraining tabs. The attachment tab possesses a pair of apertures 43,44, by which the hose support is hung over projections (not shown) in the wall or other support structure. At least two of these apertures (and two projections from the support structure) are required, as a single aperture would leave the hose support vulnerable to pivoting around the projection, an inconvenient prospect. The shape of these apertures is a matter of choice, depending on how the hose support is to be held.

Beneath the bearing surface 20, and connected to the attachment tab 40 is a brace 50. The purpose of this brace is to lend structural rigidity to the hose support. Since all prior art hose supports within the general category under consideration are fabricated from a plurality of elements, this means that the attachment tab must be connected to the bearing surface in some manner preventing the attachment tab from bending and breaking free of the bearing surface after some use.

Figure 2:
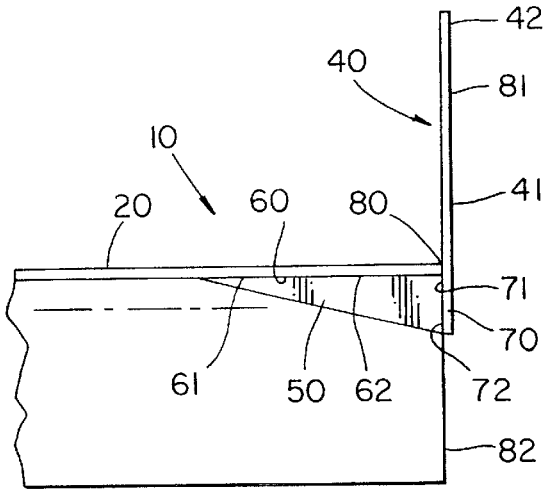
FIG. 2 (PRIOR ART)
FIG. 2 is a sectional view of a portion of the device shown in FIG. 1, taken through section 2—2 of FIG. 1.

Thus, referring to FIG. 2 for clarity, the brace 50, in such a typical prior art hose support 10, is normally welded to the bottom of the bearing surface 20 at one or more points 61,62 at their interface 60. In order to increase the desired rigidity, the brace is also normally welded at one or more points 71,72 at the interface 70 between the brace and the attachment tab 40. To complete the rigid assembly of the elements of such a prior art device, an additional weld is normally applied at the junction 80 between the bearing surface and the attachment tab.

Accordingly, the device, which is typical of prior art hose supports of the general category under consideration, utilizes three separate elements, which much be separately fabricated, stored, inventoried and retrieved, and which must be welded together in at least three spots, and often more. It can easily be appreciated that a great deal of time and labor is thus expended.

I have found that sufficient structural rigidity can be achieved, at diminished cost in time, labor and materials, through the unitary structure constituting the essence of the present invention.

Figure 3:
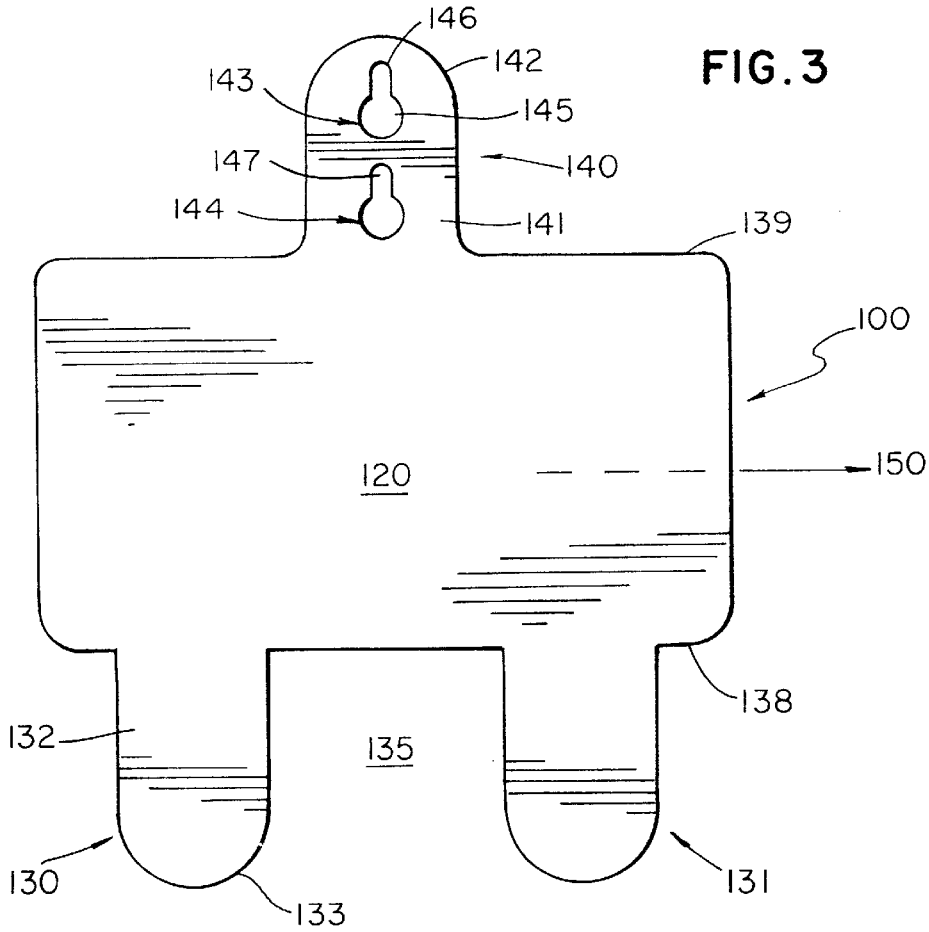
FIG. 3 is a plan view of the stamped blank of one embodiment of the present invention.

Referring to FIG. 3, the blank 100 from which the hose support 200 of the preferred embodiment of the present invention is formed comprises a rectangular bearing surface 120, with a pair of restraining tabs 130, 131 projecting from one of its longer sides 138 and a single attachment tab 140 projecting from its opposite longer side 139. Each of these restraining tabs comprises a base portion 132 and a curved apex 133, for the reasons previously discussed in the prior art context.

The attachment tab 140 likewise comprises a base portion 141 and a curved apex 142 for similar reasons. The attachment tab is provided with a pair of apertures 143,144, mutually aligned transversely to the longitudinal axis of the rectangular bearing surface. Each of these apertures comprises a round portion 145 with an essentially linear portion 146 projecting therefrom in a direction away from the longitudinal axis of the rectangle. As seen more clearly in FIG. 4, the width of the linear portion is less than the diameter of the round portion. This is so that when the hose support 200 is attached to large headed nails or similar projections embedded in a support structure, these heads can be slipped through the round portion of each aperture and the hose support can then be dropped downward slightly so that the shanks of the projections can rest firmly and securely within the linear portions of the apertures.

Initially, it will be observed that the attachment tab 140 is transversely nested between the restraining tabs 130,131. That is to say, in plan view (as shown in FIG. 3) the longitudinal position of the attachment tab, along the longitudinal direction 150 of the rectangle, is entirely between the longitudinal positions of the respective restraining tabs. This nested configuration allows successive blanks 100 to be cut from a strip of sheet metal (whose longitudinal axis is transverse to that of the individual blanks) with the attachment tab of one blank within the space 135 between the respective restraining tabs of the previous blank. When multiplied by thousands of such blanks, it can easily be seen that a great deal of sheet metal is saved in the process, which reduces the cost of production and the ultimate price of the hose supports 200 to the consumer.

Thus, by means of the first stage of a conventional two-stage die, the blanks 100 are cut, in succession, from a long strip of material—preferably 16 gauge hot-rolled steel—as unitary structures from which the final hose supports 200 are pressed by the second stage of the die.

Figure 4:
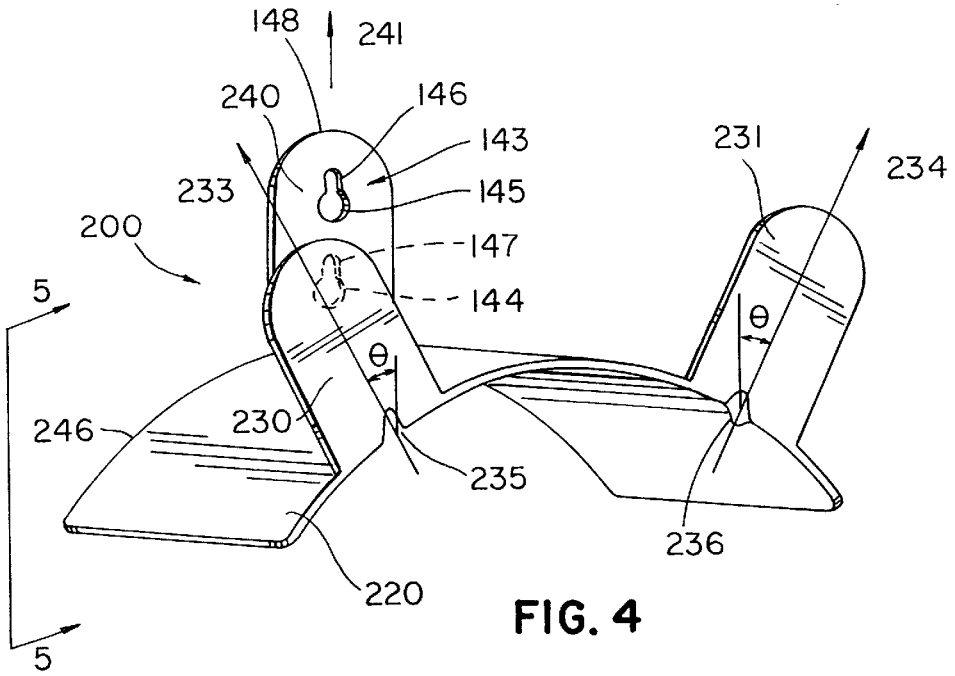
FIG. 4 is a perspective view of one embodiment of the present invention.

The hose support 200 resulting from pressing of the blank 100 by means of the second stage of the two-stage die is configured as shown in FIG. 4. From the shape of the blank and of the final hose support, the configurations of the two-stage die will be clearly apparent to die makers with ordinary skill in the art. Thus the specifics and construction details of the die need not be described.

Suffice to say, in reference to FIG. 4, that the second stage die causes the rectangular bearing surface 120 of the blank to become curved about an axis (not shown) that is parallel to the plane of the bearing surface and normal thereto. Typically, this curvature will be circular, resulting in transformation of the longitudinal axis of the blank into a circular arc. However, it need not be circular, as any convenient shape can be implemented, so long as the basic goal of providing a cost-effective, unitary hose support that can adequately serve its principal purpose can be met.

Other effects of the second-stage die will be observed from FIG. 4. For example, the attachment tab 140 of the blank 100 is bent into the final attachment tab 240 of the hose support 200, normal to the bearing surface 220 of the hose support. Likewise, the restraining tabs 130,131 of the blank are each bent upward. While they may be made normal to the bearing surface, this is not entirely necessary, and they can project slightly outward without comprising their structural integrity. From the nature of the forces that would be imposed on these restraining tabs, particularly by a long, heavy hose, it would appear to be preferable—perhaps even essential—to cause these restraining tabs to be strictly normal to the bearing surface, so that outward-directed forces would not cause them, in turn, to be bent outward and ultimately perhaps to break off.

However, I have found that the reinforcement dimples 235,236 that are introduced into the hose support 200 during the second-stage (pressing) process provide considerable resistance to outward-directed forces, as well as providing additional structural integrity to the unitary structure. From FIG. 4, it will be seen that the longitudinal axes of each of these elongated reinforcement dimples is at an angle θ in respect to the corresponding longitudinal axes 233,234 of the restraining tabs 230,231. This is because I have found it simpler—and no less structurally sound—to simply cause the second-stage die to force these reinforcement dimples vertically into the structure as it is being pressed by the die, while the bearing surface is being curved and the restraining tab axes are moved outward from their original alignment with the longitudinal axis 241 of the attachment tab 240.

Indeed, I have found that, despite conventional wisdom dictating that a structural support element is required to provide structural rigidity, as discussed above, these reinforcement dimples 235,236 are all that is required to provide a unitary hose support 200 with all the strength necessary for virtually any application—without the need for additional elements and time/labor consuming processing steps. This is one of the essential features of my invention and one which constitutes a significant departure from the prior art, in that it facilitates the manufacture of a unitary hose support with amply sufficient strength and rigidity, for far less cost than the prior art devices.

Figure 5:
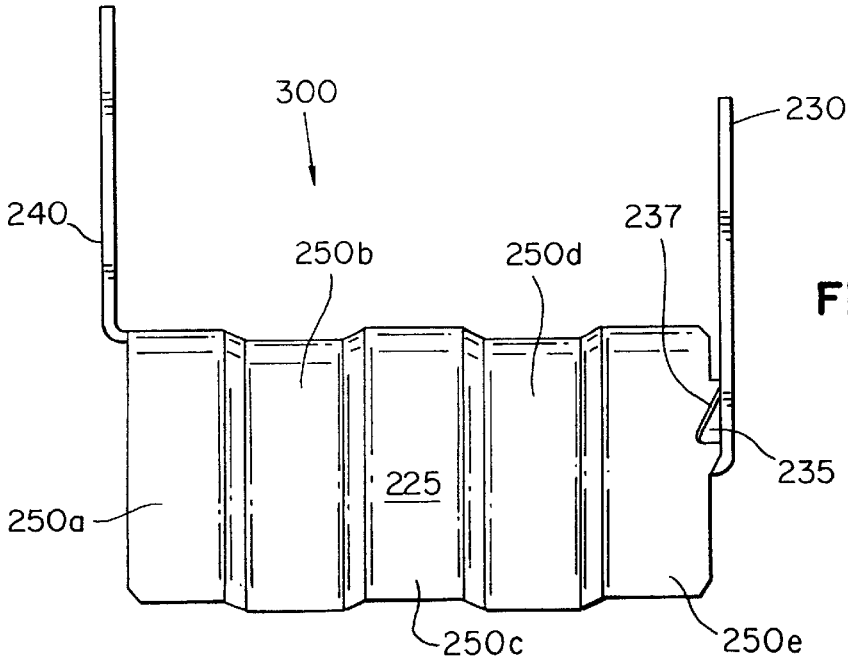
FIG. 5 is an edge view of another embodiment of the present invention, taken in the direction of the arrow 5 shown in FIG. 4.

FIG. 5 illustrates an alternative embodiment of the invention, which is shown as viewed in alignment with the longitudinal axis (perpendicular to the drawing) of the bearing surface 225 with the attachment tab not shown. Here, the hose support 300 displays a corrugated bearing surface, comprising a plurality of stepped regions 250*a*–250*e*. These facilitate the process of wrapping a hose around the hose support by providing guide channels. They also cause the hose support in this embodiment to tend to hold the hose in place somewhat more snugly. Finally, they do not reduce structural integrity, and appear actually to increase it. The number of these stepped regions may be selected by the operator for any particular application, although I prefer five of them, as shown in FIG. 5.

It will be noted, in passing, that FIG. 5 clearly shows the upper surface 237 of the reinforcement dimple 235 in restraining tab 230, whose lower surface cannot be seen in this view.

In use, the hose support 200,300 is suspended onto a support structure by sliding its apertures 144,145 over projections imbedded in the support structure and then allowed to fall slightly so that the projections can rest securely in the longitudinal portions 146,147 of the apertures. Since the rear surface 148 of the attachment tab 240 is flush (i.e., coplanar, in respect to the support structure) with the rear edge 246 of the bearing surface, due to the unitary character of the hose support of the present invention, the entire length of that rear surface abuts the support surface. This means that all of the downward forces imposed by the hose (which can be long and heavy) are transferred toward the support structure. That, in turn, causes the hose support to be held more securely against the support structure than in the case of the prior art device described above, where construction from attached individual elements necessarily creates a space between the rear surface 81 of the attachment tab 40 and the rear edge 82 of the bearing surface (see, particularly, FIG. 2).

The finished hose support can be painted, powder-coated or enameled for protection against the elements or simply to provide a smoother hose-support contact. Alternatively, galvanized metal or similarly corrosion-resistant material can be chosen to reduce deterioration from the elements and to provide additional benefits.

What has been described is, therefore, a structurally sound, unitary hose support comprising a single element, which can be fabricated more easily and inexpensively than prior art multi-element devices and which can be supported on a wall or similar structure more securely.

Of course, modifications might be made to the invention. For example, different materials may be chosen for fabrication of the device. The number or shape of the attachment or restraining tabs, or their relative placement or angular orientation in respect to the curved plane of the bearing surface, might be altered. The shape or angular orientation of the reinforcement dimples might be changed. The number of rib stiffener steps in the bearing surface of the alternative embodiment described might be changed, as might their relative width and respective depth. Indeed, the plan shape of the bearing surface could be changed from a rectangle, and the nature of its curvature from essentially circular to perhaps even a discontinuous curve or no curve at all could be selected.

These and other modifications would be within the capability of the ordinary practitioner, based on these teachings, and are merely suggested as illustrating the fact that many further alternations and modifications may be made by those having ordinary skill in the art without departing from the spirit and scope of the invention. Therefore, it must be understood that the illustrated and described embodiments have been set forth only for the purpose of example and that these should not be taken as limiting the invention as defined by the claims to follow.

The words used in this Specification to describe the invention and its various embodiments are to be understood not only in the sense of their commonly defined meanings, but also to include, by special definition in this Specification, structures, materials or acts beyond the scope of the commonly defined meanings. Thus if an element can be understood in the context of this Specification as including more than one meaning, then its use in a claim must be understood as being generic to all possible meanings supported by the Specification and by the word itself.

The definitions of the words or elements of the following claims, therefore, include not only the combination of elements which are literally set forth, but all equivalent structures, materials or acts for performing substantially the same function in substantially the same way to obtain substantially the same result.

Insubstantial departures from the claimed subject matter as viewed by a person with ordinary skill in the art, now known or later devised, are expressly contemplated as being equivalently within the scope of the claims, even though not performing exactly the same function in substantially the same way to obtain substantially the same result. Therefore, substitutions now or later known to one with ordinary skill in the art will be within the scope of the defined elements. The claims are thus to be understood to include what is specifically illustrated and described above, what is conceptually equivalent, what can be obviously substituted and also what essentially incorporates the essential idea of the invention.

I claim:

1. A unitary structure for supporting a flexible hose, said unitary structure consisting of one continuous member, said member comprising:

a curved principal element having a longitudinal axis along the curvature therein;

an upper surface;

a lower surface;

a first principal side;

a second principal side, said longitudinal axis lying between said first and second principal sides;

attachment means extending upward from said first principal side; and two restraining tabs extending upward from said second principal side; and further including two junction reinforcement means, one said junction reinforcement means associated with each restraining tab, said junction reinforcement means comprising a depression into said lower surface of said curved principal element in proximity to said second principal side, said depression extending upward as a protrusion from said upper surface where said restraining tab extends upward from said curved principal element.

2. The unitary structural as recited in claim 1, wherein said restraining tabs extend upward from said second principal side.

3. A unitary structure for supporting a flexible hose, said unitary structure consisting of one continuous member, said member comprising:

a curved principal element having a longitudinal axis along the curvature therein;

an upper surface;

a lower surface;

a first principal side;

a second principal side, said longitudinal axis lying between said first and second principal sides;

one attachment tab extending upward from said first principal side;

two restraining tabs extending upward from said second principal side, wherein said restraining tabs are planar elements, extending perpendicularly from said upper surface at said second principal side; and further including two junction reinforcement means, one said junction reinforcement means associated with each restraining tab, said junction reinforcement means comprising a depression into said lower surface of said principal element in proximity to said second principal side, said depression extending upward as a protrusion from said upper surface at the junction of said restraining tab and said principal element.

4. The unitary structure as recited in claim 3, wherein said attachment tab is provided with support facilitating means to enable support of said unitary structure by an external structure.

5. The unitary structure as recited in claim 4, wherein said support facilitating means comprises an aperture within said attachment tab.

6. The unitary structure as recited in claim 5, wherein two apertures are provided in said attachment tab.

7. The unitary structure as recited in claim 6, wherein said attachment tab is a planar element extending perpendicularly from said upper surface at said first principal side, and said two apertures are mutually aligned along an aperture alignment axis that is perpendicular to said first principal side.

8. The unitary structure as recited in claim 3, wherein said principal element is rectangular, said principal element being curved about an axis of curvature transverse to said longitudinal axis, said axis of curvature displaced downward from said lower surface, and said first and second principal sides comprise the longer sides of said rectangular principal element.

9. The unitary structure as recited in claim 8, wherein said curvature is substantially circularly arcuate, and said axis of curvature is the axis of rotation.

10. The unitary structure as recited in claim 3, further comprising a plurality of reinforcement ribs, each said rib extending parallel to said longitudinal axis along said curved principal element, said ribs alternately extending upward and downward, in transverse progression from said first side to said second side.

11. The unitary structure as recited in claim 10, wherein the thickness of said principal element is substantially consistent from said first side to said second side.

12. The unitary structure as recited in claim 10, wherein said rib adjacent said first side and said rib adjacent said second side each extend upward.

13. The unitary structure as recited in claim 10, wherein five ribs are provided, three of said ribs extending upward, interspersed with two of said ribs extending downward.

* * * * *